United States Patent [19]

Mesek

[11] 4,073,852

[45] Feb. 14, 1978

[54] METHOD OF MANUFACTURE FOR A FABRIC USEFUL IN A DISPOSABLE DIAPER

[75] Inventor: Frederick K. Mesek, Tinley Park, Ill.

[73] Assignee: Johnson & Johnson, New Brunswick, N.J.

[21] Appl. No.: 685,961

[22] Filed: May 13, 1976

Related U.S. Application Data

[60] Continuation-in-part of Ser. No. 475,081, May 31, 1974, abandoned, which is a division of Ser. No. 345,348, March 26, 1973, Pat. No. 3,837,343, which is a continuation-in-part of Ser. No. 187,249, Oct. 7, 1971, Pat. No. 3,730,184.

[51] Int. Cl.[2] ..... D04H 1/58

[52] U.S. Cl. ..... 264/122; 264/128; 428/212; 428/260; 428/264; 428/913

[58] Field of Search ..... 264/112, 122, 128; 128/284, 287; 428/212, 260, 264, 913

[56] References Cited

U.S. PATENT DOCUMENTS

| | | | |
|---|---|---|---|
| 3,663,348 | 5/1972 | Liloia et al. | 128/284 |
| 3,794,537 | 2/1974 | Rahmes | 264/112 |

*Primary Examiner*—Robert F. White
*Assistant Examiner*—James R. Hall

[57] ABSTRACT

A method for preparing a non-woven fabric which is less wettable in its marginal portions than in its central portion. The fabric comprises a highly water-absorbent web of mixed long and short fibers that is through-bonded throughout its dimensions with a binder (adhesive) to retain the fibers in their assembled relationship. Since the binder, in its final set stage, is hydrophobic in character and renders the resulting fabric more or less water repellent, the invention involves treatment of the mid-portion of the bonded fabric with a wetting agent (surfactant) to minimize the water-repellent effect of the binder and to make the mid-portion of the fabric readily wettable. Marginal portions of the bonded fabric are not treated with a wetting agent, so that these portions of the fabric throughout their dimensions are more or less water repellent. By this is meant that the marginal portions of the bonded fabric are difficultly wettable as compared to the mid-portion of the fabric. As indicated, the binder material at the side edges of the fabric is present throughout the thickness of the fabric, and hence it is effective to prevent liquid that is wetted into the central portion of the fabric from wicking readily outwardly. The fabric of the invention has particular utility as a facing layer in a disposable diaper that includes an absorbent pad and a water-repellent backing member, since it minimizes liquid leakage from the side edges of the diaper.

8 Claims, 9 Drawing Figures

FIG. 7
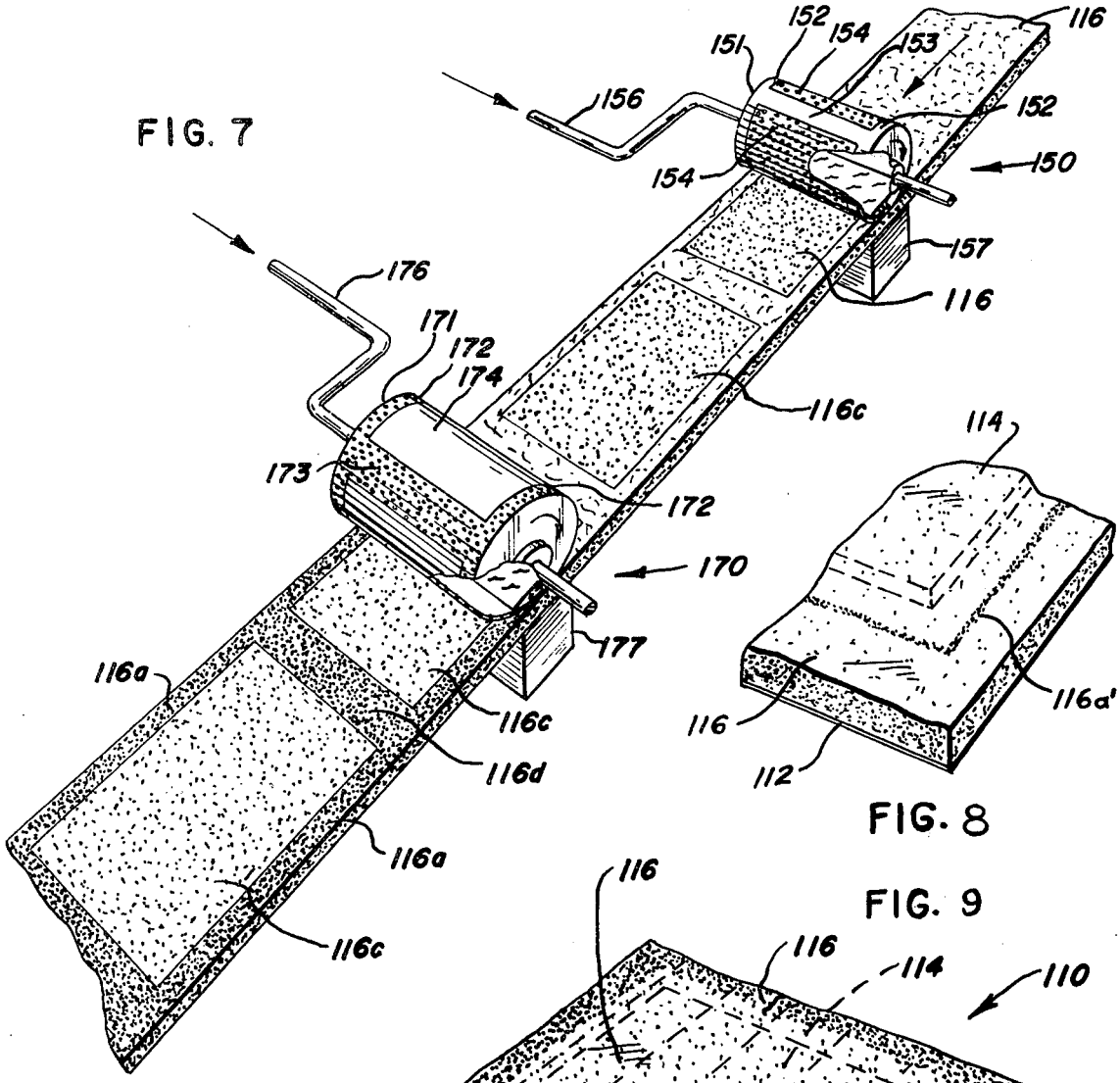
FIG. 8
FIG. 9
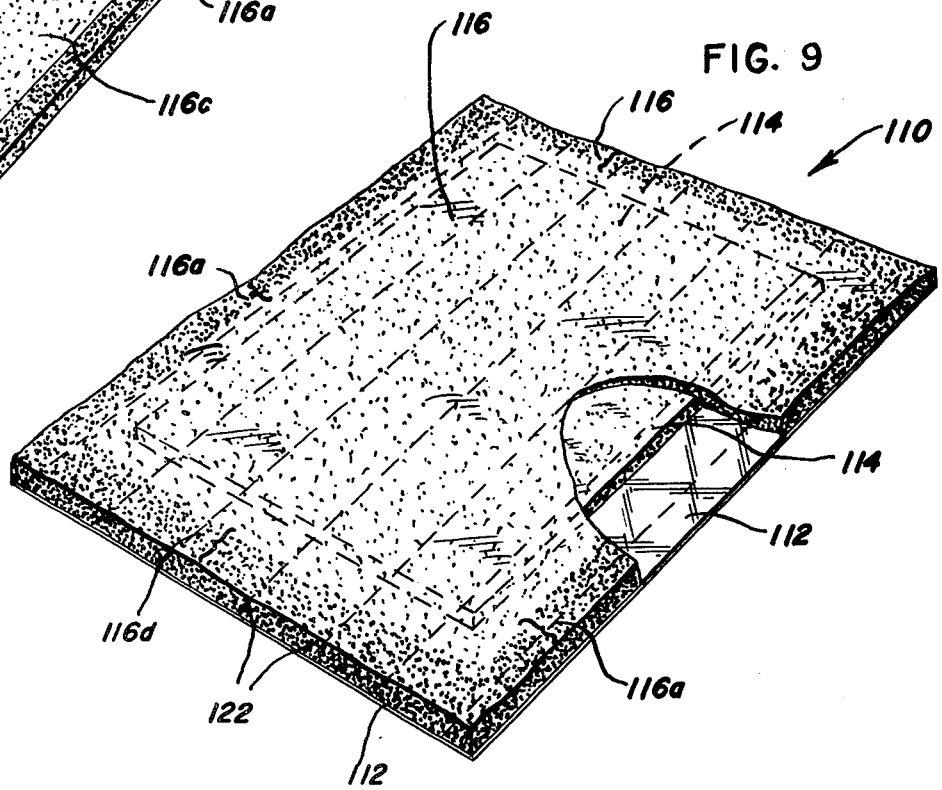

METHOD OF MANUFACTURE FOR A FABRIC USEFUL IN A DISPOSABLE DIAPER

CROSS-REFERENCE TO RELATED APPLICATIONS

This application is a continuation-in-part of application Ser. No. 475,081, filed May 31, 1974 now abandoned which application is a division of application Ser. No. 345,348, filed Mar. 26, 1973, now U.S. Pat. No. 3,837,343, said application Ser. No. 345,348 being a continuation-in-part of application Ser. No. 187,249, filed Oct. 7, 1971, now U.S. Pat. No. 3,730,184.

BACKGROUND OF THE INVENTION

Disposable diapers have met with increased commercial acceptance in recent years primarily because of their convenience, as opposed to cloth diapers, which need to be laundered once soiled. Many different constructions have been proposed and used, and some have met with widespread commercial success in spite of certain inadequacies in functional properties.

One of the most serious prior art problems has been the inability to provide a suitable construction that would keep moisture away from the surface of the diaper which comes into contact with the infant's skin and thereby avoid skin irritation and infection. Mesek et al. U.S. Pat. No. 3,612,055, issued Oct. 12, 1971, discloses several diaper constructions that function extremely well in keeping moisture away from an infant's skin, while at the same time handling a full volume of urine.

These functions are accomplished by a multilayer diaper comprising, in order, a fibrous facing layer which is to be brought into contact with the infant's skin, a layer of highly porous, loosely compacted cellulosic batt, a paper-like, densified, highy compacted cellulosic fibrous layer integral with the loosely compacted batt and an impervious backing sheet adhered to the densified layer throughout the interface therebetween. The facing layer is of porous construction and its fibers have less wettability for water than the fibers of the loosely compacted batt, resulting in a tendency for liquid to flow from the facing web into the batt. The densified fibrous layer has a smaller average pore size than the loosely compacted batt, resulting in a tendency for liquid to flow preferentially from the batt into the underlying densified layer rather than to other areas of the batt, thus tending to restrict wetting in the batt to an area of moderate size. Liquid flowing into the densified layer tends to spread laterally because of its wicking action and liquid which might pass through the densified layer during discharge (when flow is rapid) is held back by the impervious backing sheet for sufficient time to permit absorption to take place. Liquid in excess of the absorptive capacity of the densified layer is forced back by the impervious layer into the dry portion of the loosely compacted batt, thus utilizing the additional absorptive capacity therein.

The facing layer in the above-described diaper is comprised of a mixture of long and short fibers that are held together by a binder having a wetting agent therein which reduces the water repellency of the facing layer, so that urine may readily pass therethrough and into the loosely compacted batt. The binder and wetting agent are uniformly applied across the width and thickness of the facing layer so that the facing layer has uniform functioning properties. While the above type of facing layer has functioned satisfactorily in use, in certain circumstances, particularly when the diaper becomes saturated, there has been a tendency for urine to wick along the facing layer and cause leakage at the edges of the diaper. It has been proposed to obviate this problem by spraying, or otherwise applying, a water-repellent agent on the edges of the facing layer in an effort to prevent urine from wicking outwardly, but this proposal has proven to be unsatisfactory, since the water-repellent agent does not penetrate throughout the thickness of the fabric and hence does not prevent the wicking action.

SUMMARY OF THE INVENTION

The present invention provides a method for producing an improved non-woven fabric having particular utility as the facing layer in disposable diapers of the type disclosed in the above-mentioned U.S. Pat. Nos. 3,730,184 and 3,837,343. The facing layer produced by the method of the present invention is absorbent and readily wettable in the central portion and water-repellent (difficultly wettable) at at least two opposite marginal portions. The facing layer may be conveniently produced by treating the mid-portion of a web of mixed short and long fibers with a liquid binder material and a wetting agent, and treating marginal portions of the web with the liquid binder material only. The liquid binder material is used in an amount sufficient to impart to marginal portions of the facing layer, after the liquid binder material has been solidified (i.e., after the binder has cured or set), the desired degree of water repellency.

In the application of the binder material to the web of mixed short and long fibers, liquid binder material is flowed onto the web in an amount in excess of the minimum amount required to retain the fibers in their assembled relationship when the liquid binder material has been solidified. The liquid binder material is drawn through the facing layer, as by suction, so that the web is thoroughly impregnated. As already indicated, the binder material applied to the central portion of the web has incorporated therein a wetting agent, whereas that applied to the marginal portions does not, so that a means is provided in the resulting facing layer to effectively prevent urine from wicking readily outwardly.

BRIEF DESCRIPTION OF THE DRAWINGS

FIG. 7 is an enlarged perspective view illustrating alternate binder applying means utilized in the production line of FIG. 4, and suitable for the production of the diaper of FIG. 9;

FIG. 8 is an enlarged fragmentary perspective view illustrating a corner of another variation of the diaper of this invention; and FIG. 9 is a perspective view, with certain portions broken away for clarity of illustration, of an open unfolded diaper illustrating the water-repellent marginal portions of another embodiment of this invention.

DETAILED DESCRIPTION OF THE INVENTION

Figures 1, 2, 3, 4:
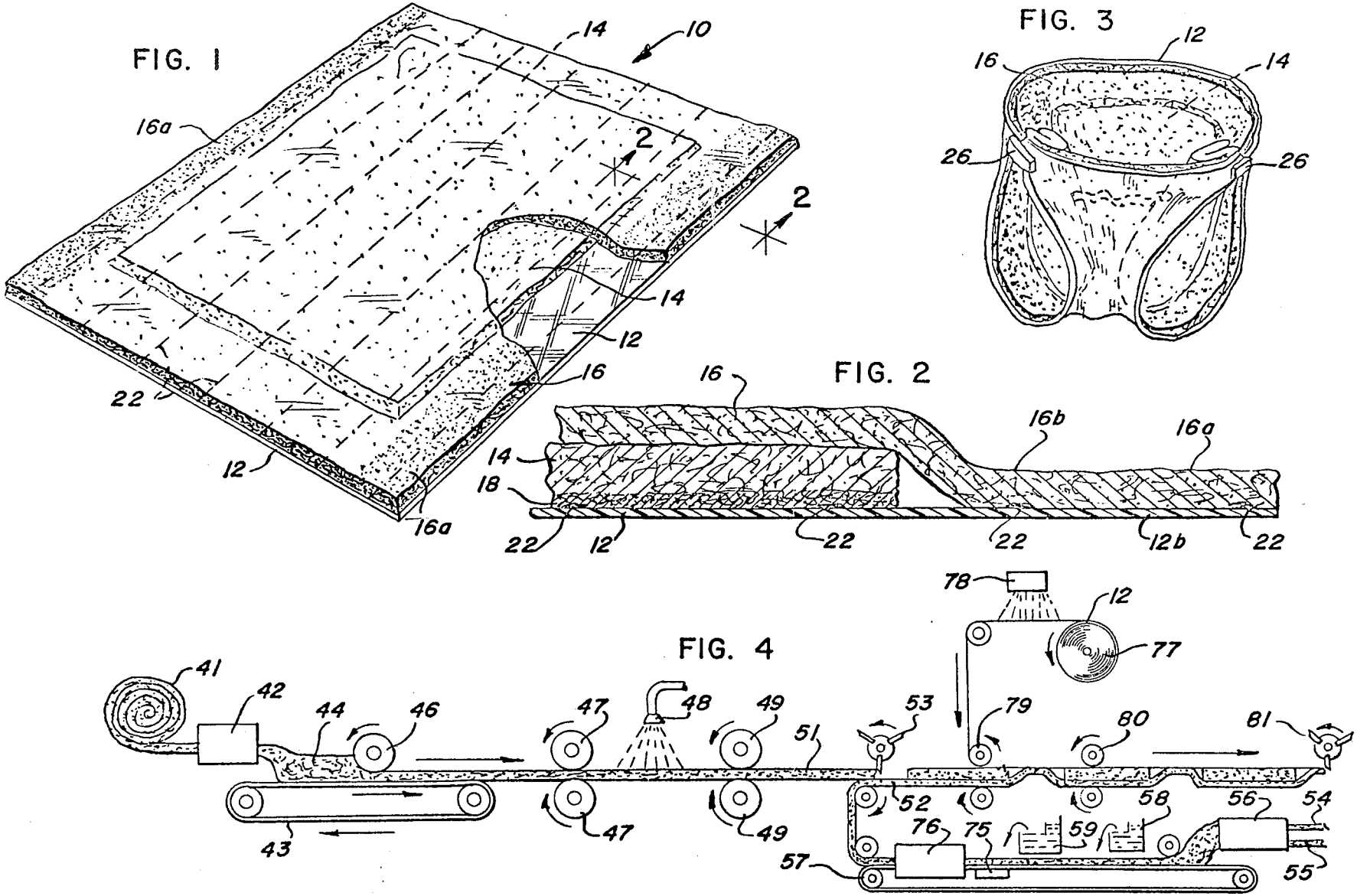
FIG. 1 is a perspective view, with certain portions broken away for clarity of illustration, of an open unfolded diaper of one embodiment of this invention.
FIG. 2 is an enlarged cross-sectional view taken generally along line 2—2 of FIG. 1.
FIG. 3 is a perspective view on a reduced scale of the diaper of FIGS. 1 and 2 in its configuration after being put on an infant.
FIG. 4 is a simplified schematic view of the production line on which the diaper is made.

Referring to the drawings, and particularly to FIGS. 1 and 2, the diaper assembly 10, when fully opened and laid out flat, comprises a lowermost water-impervious sheet 12 which is rectangular in shape, a highly water-absorbent fibrous pad, or batt 14, which is also rectangular in shape, but smaller than the impervious sheet and centrally disposed thereon, and an overlying facing layer 16 of fibrous material, which is also rectangular in shape, equal in dimension, and coterminous with the impervious sheet and in contact therewith in the portions of the diaper extending peripherally beyond the absorbent pad, i.e., in the portions **16*b* and 12*b* of facing layer 16 and impervious sheet 12, respectively. The batt 14 has a paper-like densified highly compacted lowermost fibrous layer 18 which is adhered to the impervious sheet by bead lines of adhesive 22 substantially throughout the interface therebetween. Portions 16*b* and 12*b* are also adhered to each other by bead lines 22**.

In the preferred embodiment of the invention, moisture-impervious sheet 12 is formed of polyethylene having a thickness of approximately 0.001 inch. The sheet may be smooth, or may be embossed to improve its drape and feel. Other suitable flexible moisture-impervious sheets may be used in accordance with the invention, such as, for example, polyethylene terephthalate sheets having a thickness of about 0.0005 inch.

In the embodiment of FIG. 9, the general structure of the diaper is similar to the structure described above with reference to FIG. 1; and all of the elements described above find their counterparts in FIG. 9 and are designated in the latter FIGURE by numerals higher than those of FIG. 1 by 100. For convenience, these elements will be referred to herein by the reference numerals they bear in FIG. 1.

In addition to the foregoing elements, there are in the facing layer of the diaper of FIG. 1 side edge portions **16*a* which are of lesser wettability than the remainder of the facing layer. The diaper of FIG. 8 has similar side edge portions 116*a* and also has end edge portions 116*d* which are also of lesser wettability than the remainder of the facing layer. Together, portions 116*a* and 116*d*** comprise a rectangular border or "picture frame" of reduced wettability surrounding the central portion of the facing layer.

The relative sizes of the central portion and the edge portions in the embodiments of FIGS. 1 and 8 are matters of design dependent on a number of factors including the overall size of the diaper and whether it is intended for a newborn infant or for a larger and more active baby. Generally, the central portion will comprise from about 50% to about 90% of the total area of the diaper and the marginal portions will range from about ½ inch to about 2 inches in width.

Batt 14 is formed of loosely compacted short cellulose fibers, such as wood pulp fibers, or cotton linters, or mixtures thereof, which are primarily held together by interfiber bonds requiring no added adhesive, as is known in the art. Briefly, this batt is a low bulk density coherent web of loosely compacted cellulose fibers preferably comminuted wood pulp fibers in the form of so-called "fluff."

The term "short fibers," as used herein, refers to fibers less than about ¼ inch in length, in contrast to "long fibers," or "textile length fibers" which are longer than about ¼ inch in length, and generally are between about ½ inch and 2½ inches in length. The former are substantially less costly than the latter. The classification of fibers by length may be carried out by the Clark Classification procedure described in the test manual of The Technical Association of Pulp and Paper Industry (TAPPI-T233 SU64).

The paper-like densified layer 18 of batt 14 is formed by a slight moistening of one surface of the batt followed by the application of pressure thereto. The nature of the batt and of its densified layer and the method of producing the same are described in U.S. Pat. No. 3,017,304, dated Jan. 16, 1962.

Facing layer 16, as described in the above-mentioned Mesek et al. patent, is made up of a mixture of fibers consisting predominantly of short cellulosic fibers such as wood pulp fibers or cotton linters.

In the preferred facing layer, the short fibers are in uniform admixture with 2 percent to about 25 percent by weight of textile length fibers, such as 1.5 denier rayon fibers uniformly cut to 1½ inches length. The short and long fibers are randomly and substantially uniformly dispersed and bonded with a bonding agent such as a self-cross-linking acrylic emulsion, and as is hereinafter described in detail, the web is impregnated with a liquid binder material by flowing a solution or dispersion of the binder over the web. As a result, the binder is substantially uniformly distributed throughout the thickness of the web upon solidification.

In accordance with another preferred embodiment of this invention, the facing layer comprises a mixture of long and short fibers which varies in composition with respect to proportions of long and short fibers in different thickness portions of the web. Such webs and the methods of forming them are disclosed in commonly-owned U.S. Pat. No. 3,768,118 to Ruffo et al. the disclosure of which is hereby incorporated by reference. The preferred web of the Ruffo et al. patent for the facing layer has a given overall concentration of long and short fibers, a greater concentration of long fibers at one major face (the exterior face of the facing layer as the diaper is assembled), a greater concentration of short fibers at the opposite major face and a uniform transition of fiber concentrations at different thickness portions at increasing distances from one major face to the other.

In the diaper of the aforementioned Mesek et al. patent the binder fluid impregnated into the facing web contains a surfactant or wetting agent to partially counteract the water repellency of the bonding agent and bring the facing layer to the desired degree of wettability.

In accordance with the present invention, it is only the central portion of the web, comprising the major portion of its area, and including all portions likely to be initially wetted when the diaper is in use that is treated with a wetting agent. In accordance with the present invention, the marginal end and side and/or end edges of the facing layer are treated with a lesser amount of wetting agent, or no wetting agent at all. By not treating the marginal edges of the facing layer with a wetting agent, these portions of the web are less wettable and less absorbent than the mid-portion of the web, which minimizes any tendency for urine to spread outwardly in the facing layer. The wetting agent, when present, is incorporated into the liquid binder material which is applied to the web in the desired locations thereof.

Facing layers suitable for use in this invention have fabric weights in the range of 1 to 5 oz./yd.$^2$, and preferably 1 to 2 oz./yd.$^2$, and densities less than about 0.15 gm./cc., generally in the range of about 0.05 to about 0.1 gm./cc. The dry strength of the facing layer, for a fabric having a weight of about 1.5 oz./yd.$^2$, is at least about 0.12 lbs./in., preferably about 0.15 lbs./in. of width in the machine direction and at least about 0.08 lbs./in., preferably about 0.10 lbs./in., of width in the cross direction. The fabrics have unusually good elongation, loft, softness and drape characteristics in comparison to prior products incorporating any substantial amount of short fibers.

An important aspect of this invention is the provision for selective wettability among the above-described fibrous components of the diaper and within the components themselves, such that the moisture is selectively drawn from the facing layer into the body of the batt and then from the body of the batt into the densified layer thereof.

The least wettable of the fibrous elements of the diaper of this invention is facing layer 16. However, even in the facing layer the ability to be wetted by water is desired. Water repellency in the central portion of the facing layer is not desired since, at the desired fiber densities in the facing layer, water repellency can prevent the liquid from penetrating into the facing layer and the absorbent layers behind it, just as a tent fabric holds back penetration of rain water. For this reason, the central portion of the facing layer is treated with a wetting agent, such as an anionic or a non-ionic surfactant, to moderate and reduce the water repellency which may be imparted to the short and long fibers of the web by the binder or bonding agent which bonds them into an integral layer. After treatment with a wetting agent, the central portion of the facing layer is receptive to penetration by urine but remains less wettable than the batt.

Water repellency, or at least reduced wettability, is desirable at the marginal edges of facing layer 16 to minimize any tendency for urine to wick along the facing layer toward the marginal edges thereof. In accordance with the present invention differential wettability in the facing layer can be accomplished by not treating the marginal edges of the facing web with a wetting agent, so that only fibers and solidified binder material are present at the marginal edges, or by applying more liquid binder material to the marginal edges of the facing web than to the mid-portion thereof.

A useful parameter of wettability is the liquid-fiber contact angle for the individual fibers of the layer, the contact angle approaching 90° for fibers which are difficultly wettable, exceeding 90° for fibers which are highly water repellent, and approaching zero for fibers which are highly wettable by water. The liquid-fiber contact angle may be determined from high speed interface photographs of individual dry fibers, held in a clamp, and advanced into the wetting liquid (water) at a rate of 0.5 cm./sec. by techniques known in the art.

In any particular facing layer, the liquid-fiber contact angle for individual fibers may vary considerably because of unevenness of distribution of the water-repellent bonding agent and unevenness of distribution of wetting agent and/or surfactant. Nevertheless, a liquid-fiber contact angle between about 30° and about 60° for most (over 50 percent) of the individual fibers in a random selection provides suitable wettability in the central portion of the facing layer, and a liquid-fiber contact angle between about 40° and about 60° is preferable. A liquid-fiber contact approaching 90°, and preferably above 90°, gives the marginal side edges of the facing layer an adequate degree of water repellency.

The body of batt 14 is substantially more wettable than the facing layer and tends to draw liquid away from the facing layer. The individual fibers of the batt are extremely wettable, generally having liquid-fiber contact angles below about 15° and approaching zero in the optimum embodiment. The wickability, or preferential absorptivity of the body of the batt for water is limited, however, by its low density which results in a large effective capillary radius for the capillaries between adjacent fibers.

The pressure causing a liquid to enter a cylindrical capillary is expressed by the equation:

$$P = \frac{2\gamma\cos\theta}{r}$$

where

P is the capillary pressure,
$\gamma$ is the surface tension of the liquid,
$\theta$ is the liquid-fiber contact angle, and
$r$ is the capillary radius.

With a given liquid, the pressure (capillary force) increases with the cosine of the liquid-fiber contact angle (reaching a maximum where the angle is zero), and decreases with narrower capillary radii so that narrower capillaries will draw liquid from wider ones.

The relative wickability between facing layer 16 and the body of batt 14 is affected by both the relative densities of the layers and the relative wettability of the individual fibers in each layer. The facing layer is sometimes more dense than the body of the batt, tending to provide greater wickability in the facing layer, but even then the individual fibers of the batt have substantially smaller liquid-fiber contact angles than those of the facing layer, overcoming the density difference and providing a substantial overall increase in capillary pressure to absorb liquid into the body of the batt.

Densified fiber layer 18 of the batt provides the maximum capillary pressure because it combines the very low contact angle of the fibers of the batt with the high density (small capillary radius) of the densified fibers.

When urine is voided into an area in facing layer 16, it partially wets the facing layer and is absorbed therein, spreading out to a limited extent to form a roughly circular wetted zone therein. When the urine passes through the facing layer and comes into contact with the body of batt 14, it is preferentially absorbed into the body of the batt because of the enhanced wettability thereof. It spreads within the body of the batt to wet a roughly circular zone therein that is larger than the wetted zone in the facing layer. When the urine passes through the body of the batt into contact with densified layer 18, it is strongly drawn therein because of its high density and is spread laterally through a much larger substantially circular zone, or to the edges of the batt, depending on the amount of urine passed.

On occasions when a substantial amount of urine has been voided, the densified layer becomes saturated and excess urine, aided by the presence of impervious sheet 12 and its adherence to the densified layer in a discontinuous pattern substantially throughout the interface therebetween, flows into the previously dry portions of the body of the batt, and finally into the previously dry portions of the facing layer. It is to be noted, however, that such flow from a saturated densified layer is from the outermost portions of the diaper inward so that most of the facing layer remains dry until all other fibrous portions of the diaper are saturated. Furthermore, the marginal side and end portions of the facing layer are not readily wettable, and hence urine that does flow back into the facing layer flows initially into the central portion to minimize the possibility of fluid leakage at the sides of the diaper.

It is to be noted that the facing layer as assembled into the diaper is coterminous with the impervious sheet and there is no folding over of the impervious sheet to envelope any edge of fibrous material. Thus, there is no portion of the upper surface of the diaper which is covered with any plastic material, and no plastic material comes into direct contact with the infant's skin when the diaper is affixed in position by pins or tabs. Prolonged direct contact of plastic material with an infant's skin can cause irritation and infection but, nonetheless, is employed in prior art disposable diapers to provide an impervious seal to the infant's skin. The superior absorptive capacity of the diaper of this invention and its superior functioning make such plastic-to-skin contact unnecessary.

The diaper produced by the method of this invention is normally packaged and sold in a folded condition. Briefly, the side margins **12*b* and 16*b* of the impervious sheet 12 and the facing web 16, together with a portion of batt 14**, are folded inwardly in a first fold to provide as the uppermost layer of the fold, a portion of the moisture-impervious sheet. This subassembly is then folded outwardly along each edge in a second fold to cover the first folded portion and to expose the water-repellent edge portion of the facing web as the upper layer of the double fold. In the preferred embodiment, each double fold at the edge of the diaper comprises approximately ⅓ of the resulting transverse dimension of the folded diaper, leaving approximately ⅓ of the width of the folded diaper as a central unfolded and uncovered portion.

The diaper is held in its folded condition by two small central spots of adhesive applied between the main body of the diaper and the overlying sides **16*b* of the facing web, one spot on each folded side of the diaper. When the diaper is to be put on the infant, the folds are opened on one side of each of the adhesive spots, and the open portion of the diaper is put under the infant's buttocks while the folded portion is raised into the crotch region. The final form of the diaper is shown in perspective on a reduced scale in FIG. 3**.

In one form of the diaper produced by the method of the invention, as illustrated in FIG. 3, the diaper is provided with adhesive tabs 26, each having a fixed end secured to the impervious sheet 12 and a free end wherein the adhesive surface is covered with a facing sheet. The facing sheets are removed to expose the adhesive surfaces when the diaper is applied to the infant, as in the configuration shown in FIG. 3, and the free ends of the adhesive tabs are secured to opposite corners of the diaper.

The diaper made by the method of this invention may be assembled in equipment such as that schematically shown in FIGS. 4, 5, 6 and 7, FIGS. 5 and 6 being particularly relevant to the diaper of FIG. 1 and FIG. 7 being particularly relevant to the diaper of FIG. 8. As shown in FIG. 4, a roll of compacted wood pulp 41 is provided to feed a source of short cellulosic fibers to grinding mill 42 from which a stream of fibers is blown onto belt 43 as a layer 44 weighing between about 2 and about 10 oz./yd.$^2$ Mill 42 grinds the pulpboard into individual short fibers. However, in one preferred embodiment, some of the pulpboard fibers are not completely comminuted and remain joined to other fibers in small clumps, generally smaller than about ¼ inch across. It has been found that the presence of such small clumps of fibers in the body of batt 14 provides islands of increased tenacity for holding liquid. When an infant's weight on one portion of the batt densifies that portion and tends to concentrate the liquid in the densified portion, the presence of clumps of fibers elsewhere in the batt tends to hold the liquid in place. Preferably from about 2 to about 10 weight percent of the fibers should be in the form of such clumps.

The air blown layer is passed under compacting roll 46 from which it emerges with enough integrity to sustain itself as a web without the support of belt 43. The web then passes through a pair of calender rolls 47 for further compression and then under nozzle 48 which deposites a fine spray of moisture on the upper surface of the web. The moistened web then passes between another set of calender rolls 49 which exert heavy pressure on it to form a skin 51 on its upper surface. After the skin is formed, the absorbent web comes into contact with a web of facing material 52 and is supported thereby while being cut by cutter 53 into individual batts 14.

The facing material is prepared by initially feeding a source 54 of short fibers and a source 55 of long fibers to a fiber individualizing and mixing means 56, which removes the fibers from their respective sources, mixes them, and deposits them on a foraminous belt 57. The web forming means may be similar to a Rando-Webber made by the Curlator Co. To produce the diaper of FIG. 1, the web is then moved by belt 57 beneath weir boxes 58 and 59 which apply binder material to the web, as can be best seen in FIG. 5.

The facing layer, as described above, contains between 75 percent and 98 percent by weight of short fibers, not exceeding about ¼ inch in length. The average short fibers are from about 1/16 inch to about 3/16 inch in length. The web of randomly laid dry fibers of the desired mix of short and long lengths has a density from about 0.09 gm./cc. to about 0.025 gm./cc. measured by ASTM Method D-1777 at 0.16 lbs./in.$^2$ Facing layers having weights between about 1 and about 5 oz./yd.$^2$, preferably 1 to 2 oz./yd.$^2$, are generally suitable for use in this invention. One particular facing layer which has been used with satisfaction is composed of approximately 15 percent textile length fibers such as uniformly cut 1½ inches 1.5 denier rayon fibers and 85 percent fibers of individualized second cut cotton linters. This facing layer has a weight of about 2 oz./yd.$^2$ A liquid binder material, such as a self-cross-linking acrylic emulsion, is applied to the web to retain the fibers in their assembled relationship. One liquid binder material which has been employed with considerable success is a latex of a polyethyl-acrylate copolymer containing small amounts of acrylonitrile and a cross-linking monomer sold under the trademark HYCAR 2600 × 120. The liquid binder material should preferably be of the low viscosity type with a viscosity less than 5 centipoises.

The upstream weir box 58 is designed to apply the liquid binder material to only the marginal side edges of the web, and hence a barrier 60 is provided centrally of the weir box, so that the liquid binder material can flow outwardly only through the openings 61 at the sides of the weir box. The liquid binder material may be of the acrylic latex type, as described above, and a sufficient quantity thereof is flowed onto the web to completely impregnate the same throughout the thickness of the marginal edges.

The web then passes to the downstream weir box 59, which includes inwardly extending barriers 62 at opposite sides thereof which are essentially aligned with openings 61, so that the liquid binder material within weir box 59 flows outwardly through the central opening 63 between barriers 62 and impregnates the central or mid-portion of the web.

The liquid binder material which is fed to weir box 59 includes a wetting agent, such as an anionic or non-ionic surfactant, and sufficient quantities of the liquid binder material and the wetting agent are applied to the central portion of the web to thoroughly and completely impregnate the same. Typical surfactants which have been found to be suitable are the anionic surfactants such as the sulfonated alkyl ester sold under the trademark Triton GR-5 and the non-ionic surfactants such as the polyoxyethylene sorbitan monolaurate sold under the trademark TWEEN 20. The liquid binder material that is fed to the weir box 58 does not contain a wetting agent, so that the edge portions **16*a* of the facing layer are given the desired water repellent characteristics. By way of example, the edge portions 16*a*** may each extend inwardly 1 inch in a panel that is 11 inches wide.

The composition of the liquid binder material is controlled in a typical application so as to give the fabric, after curing, a dry solids add-on of about 6 percent based on the fabric weight, of which about 0.15 percent is the amount of surfactant. A suitable range for the amount of binder is from about 4½ percent to about 9 percent, based on fabric weight.

Figure 6:
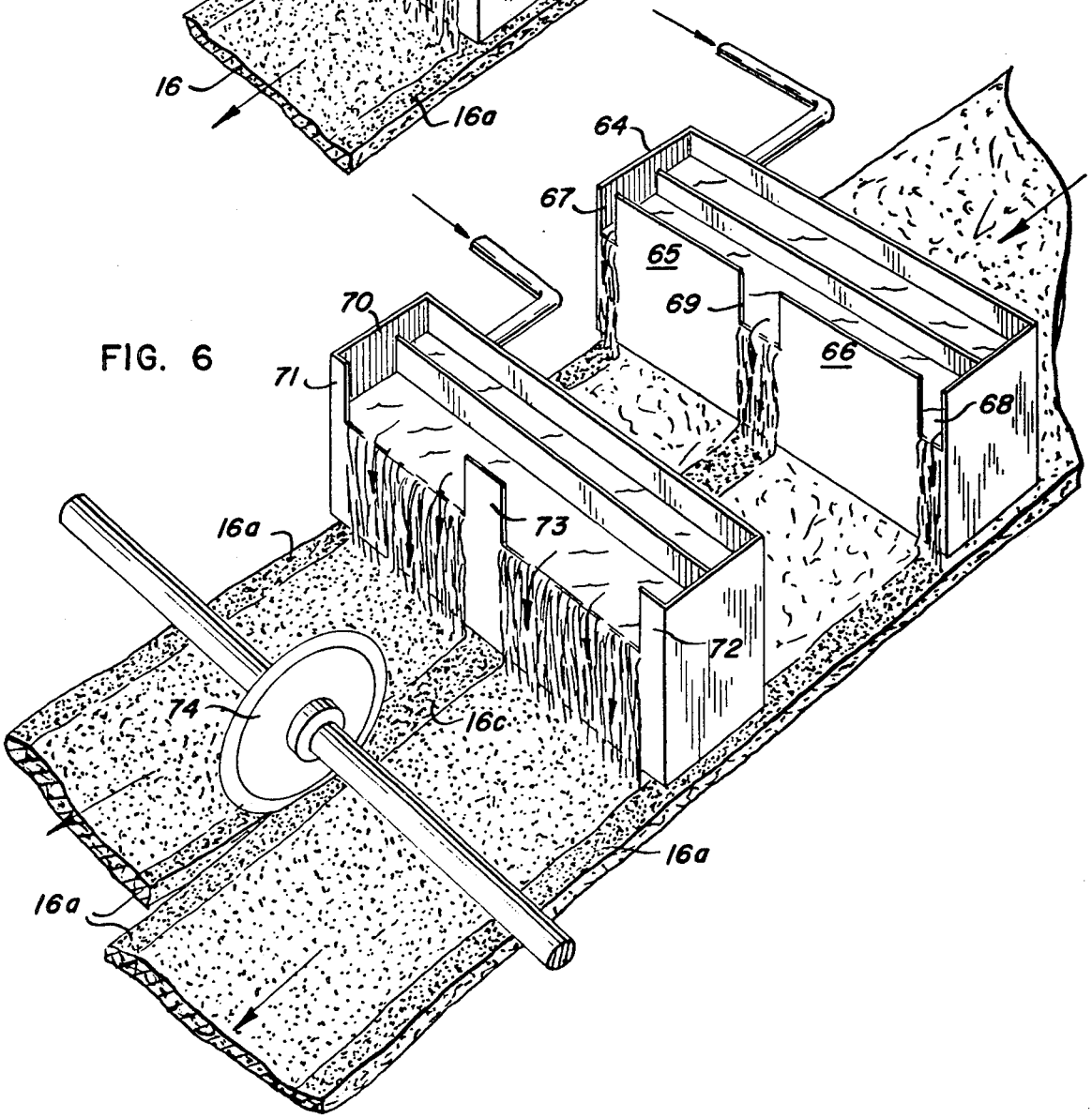
FIG. 6 is an enlarged perspective view of a modified binder applying means.

An alternative form of binder applying means is illustrated in FIG. 6, and with the arrangement illustrated therein, a pair of side-by-side facing layers can be simultaneously bonded. A web of substantially double width is initially fed past a downstream weir box 64 which includes spaced barriers 65 and 66 that define slots 67 and 68 in alignment with the side edges of the web, and that also defines an opening 69 that is disposed centrally of the web. Opening 69 is approximately twice as wide as openings 67 and 68, which are of equal width. The liquid binder material that is fed to weir box 64 is the same as the binder material that is fed to weir box 58, i.e., the liquid binder material does not contain a wetting agent.

After the web passes from beneath weir box 64, it moves beneath a further weir box 70 that includes relatively narrow projections 71 and 72 at opposite sides thereof, and a relatively wide projection 73 at the mid-portion thereof. Projections 71, 72 and 73 correspond in width to openings 67, 68 and 69, respectively. The binder material that is fed to weir box 70 is the same as that fed to weir box 59, i.e., the binder material has a wetting agent therein. As with the embodiment of FIG. 5, when the web emerges from beneath weir box 70, relatively narrow water repellent strips **16*a* are provided at opposite sides of the web. A relatively wide strip 16*c* is provided centrally of the web, with strip 16*c* being substantially twice the width of strips 16*a*. The web then passes beneath a centrally disposed cutter 74 that severs the web into two separate facing layers 16**.

With either of the above arrangements, the liquid binder material is flowed onto and through the web in quantities substantially in excess of the ultimate amount to be deposited on the fibers completely impregnating the web. The web, immediately after impregnation with the liquid binder material, passes over a suction box 75 where excess binder material is removed. The wet web is then conveyed into a drying oven 76 having a temperature of 310°–320° F., where the web is dried and the binder retained on the web cured. The resultant material has a density of 0.05 to 0.07 gm./cc., and a dry strength of about 1.4 lbs./in. of width in the cross direction. The wet strengths are about 0.9 lbs./in. of width in the machine direction and about 0.5 lbs./in. of width in the cross direction. The fabric may then be collected on a storage roll, or rolls, not shown, or pass directly to the batt material, as shown in FIG. 4.

Polyethylene film 12 is fed to the assembly from roll 77, lines of adhesive being applied from applicator 78. As described above, the adhesive is applied as parallel lines or beads between the impervious sheet and the densified layer of the batt (or the facing layer in the marginal portion of the diaper). Adhesive may, if desired, be applied as a continuous layer between the polyethylene and the batt, but such application tends to provide excessive stiffness. The adhesive may also be applied in other patterns, such as spaced dots or other forms of so-called "island" bonds, but fairly close overall adhesion between the sheet and the batt is required and no portion of the polyethylene should be more than about 2 inches from a point of adhesion. In the absence of such close overall adhesion, the polyethylene film may be separated from the densified layer to create substantial spaces in which uncontrollably large amounts of free liquid urine can accumulate.

After the facing material and polyethylene are brought into contact with opposite faces of the absorbent batts, the assembly is subjected to compression by rolls 79 and 80 to shape the diaper assembly, and the individual diapers are cut off by cutter 81.

If desired, the facing layer may be made with a veneer of long fibers on one or both surfaces thereof, in place of or in addition to the long fibers intermixed with the short fibers. In another embodiment, the facing layer may be made substantially entirely of textile length fibers bonded together with a resinous bonding agent. This embodiment can provide a facing layer of greater strength, but it is not preferred because it is more expensive and because the strength of the short fiber containing facing material is adequate in most instances.

Figure 5:
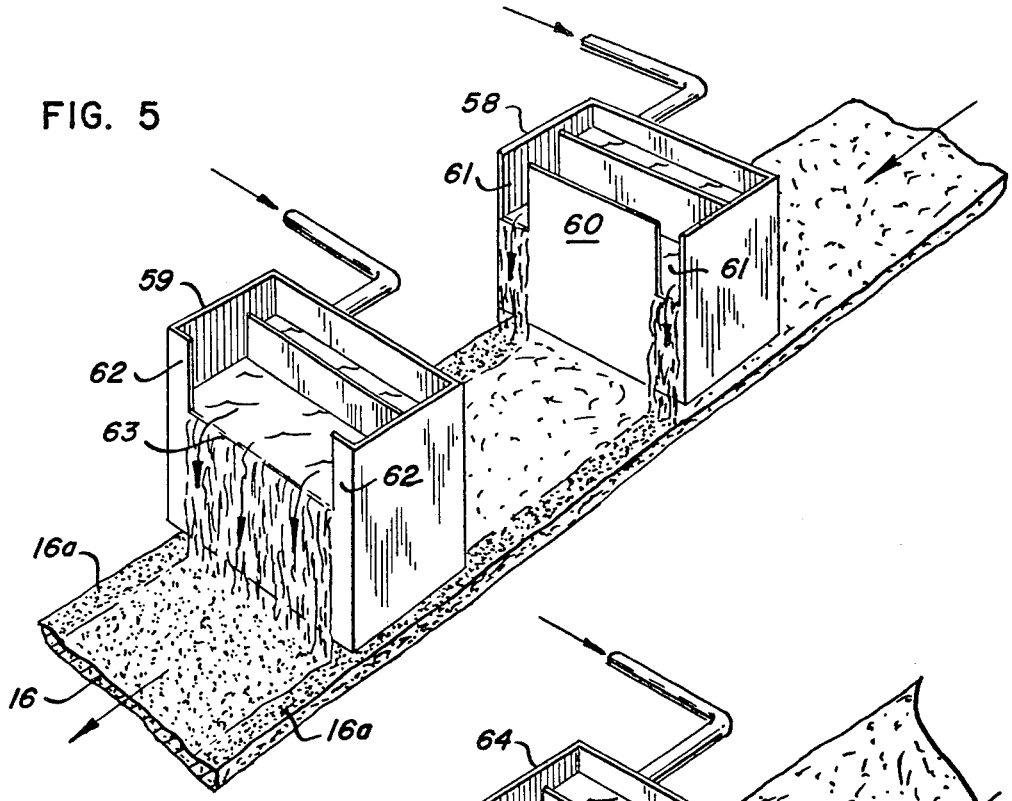
FIG. 5 is an enlarged perspective view illustrating the binder applying means utilized in the production line of FIG. 4.

The binder application system of FIG. 5 can also be used when it is desired to make a diaper with a facing layer having areas of lesser wettability in the end margins rather than in the side margins. In this instance, the facing web width is of sufficient dimension to comprise the length of the facing layer on the diaper of FIG. 1 and the web, after drying, is cut into diaper widths for assembly with the remaining diaper elements.

When it is desired to have areas of lesser wettability at both the side edges and the end edges, the system of FIG. 7 may be substituted for the system of FIG. 5 as the binder application system within the overall assembly system of FIG. 5.

The FIG. 7 system includes two spaced apart through printing assemblies 150 and 170. Assembly 150 is designed to through-print a mixture of liquid binder material and surfactant onto the central area portion of web 116 to provide rectangular area 116*c* which has the desired wettability for the portions of the facing layer through which urine must pass. To this end, roller 151 is provided which rotates in the direction of the web feed (downward and to the left as shown in FIG. 7). Roller 151 is hollow and contains a small quantity of the desired liquid binder material-surfactant mixture, maintained at a low level therein by continuous supply through line 156. The cylindrical surface of roller 151 comprises solid areas 152 and 153 corresponding respectively to the side and end margins of lesser wettability desired in the facing layer and perforated areas 154 corresponding to the rectangular area 116*c* on the web. Suction box 157 is below the web where it is in contact with roller 151 and helps pull the liquid binder material-surfactant mixture through the perforations in area 154 and through the web when the perforations are under the shallow pool of liquid and over the web. As the web emerges from under roller 151 it is wet with the liquid binder material-surfactant mixture in the areas 116*c* and dry in the areas 116*a* and 116*d*.

Roller 171 in assembly 170 serves to apply liquid binder material without surfactant to the areas left dry by roller 151. Roller 171 is also hollow and contains a shallow pool of a liquid binder material composition provided by line 176. The cylindrical surface of roller 171 is the complement of the cylindrical surface of roller 151 in that the latter is solid in area 174 corresponding to area 116*c* on the web and is perforated in areas 172 and 173 corresponding to the side and end margins of the facing layer.

The rotating roller 171 cooperates with suction box 177 to wet the previously unwetted portions of the web with the water repellent liquid binder material to produce, after drying and cutting, the desired marginal areas 116*a* and 116*d* of FIG. 8 having lesser wettability than the remainder of the facing layer.

In the modification described above, the desired water repellency is applied to the marginal portions of the facing web in strips extending from the more wettable central area to the edges of the web. In an alternate embodiment, the water-repellent marginal portion of the facing layer may be narrower strips forming a barrier to outward flow of liquid from the more wettable central area but not extending as far as the edge of the facing layer.

Facing layer 116 in FIG. 8 extends beyond the edges of batt 114, as in FIGS. 1 and 9, and strips 116*a*′ and 116*d*′ in the side and marginal area, respectively, of the facing layer between the edges of the batt and the edges of the facing layer, but spaced from both, serve as dams to prevent the flow of liquid outwardly from the more wettable central area to the edges of the diaper. If desired, the facing layer need not have both strips 116*a*′ and 116*d*′ and may instead have either side strips or end strips depending on the particular design of the diaper and the relative likelihood of leakage through the sides or through the ends of the diaper.

Strips 116*a*′ and 116*d*′ should be of sufficient width to serve as an effective barrier to the easy transmission of aqueous fluids, the necessary width being inversely related to the degree of unwettability in the strip. Generally, strips 116*a*′ and 116*d*′ range in width from about $\frac{1}{4}$ inch to about $\frac{3}{4}$ inch.

It will be understood by those skilled in the art that variations and modifications of the specific embodiments described above may be employed. For example, while facing layer 16 has been described in detail as having utility in a disposable diaper, it may also be used in similar products intended to absorb body fluids, such as a bed pad.

It should also be understood that the method of this invention is also applicable to the preparation of other forms of facing layers and other forms of absorbent pads having greater wettability than the facing layers.

Among the alternative facing layers which may be treated in accordance with this invention and provided with marginal areas of lesser wettability are porous, paper-like facing materials made of long fibers bonded together with a thermoplastic binder applied in emulsion form, such as the facing layers disclosed in Duncan et al. U.S. Pat. No. 3,180,335, issued Apr. 27, 1965, and open-celled polymeric foam facings, such as those disclosed in Maisel et al. U.S. Pat. No. 3,431,911.

Among the alternative absorbent pads which may be used in accordance with this invention are pads made of a plurality of plies of cellulose wadding, as disclosed in the aforementioned Duncan et al. patent.

Other modifications and variations will be apparent to those skilled in the art.

I claim:

1. The method of forming a non-woven fabric comprising: forming a mixed assemblage of short and long fibers into a web; impregnating said web with a liquid binder material in an amount sufficient to retain the fibers in assembled relationship when the liquid binder material is solidified, said impregnating step being performed by differential application of the liquid binder material to said web across its width so as to give different sections of said web different degrees of wettability for water, and thereafter solidifying said binder material to thereby form said non-woven fabric.

2. The method of claim 1 in which said impregnating step is performed by flowing the liquid binder material onto the formed web in an amount in excess of the minimum amount required to retain the fibers in their assembled relationship when the liquid binder material is solidified.

3. The method of claim 1 in which said web has a central portion and marginal side portions and said impregnating step is performed by including a wetting agent in a first supply of liquid binder material, and flowing said first supply of binder material onto the central portion of said web, providing a second supply of liquid binder material without a wetting agent and flowing said second supply of binder material onto the marginal side portions of said web.

4. The method of forming a non-woven fabric comprising: forming a mixed assemblage of short and long fibers into a web; and impregnating said web with a liquid binder material in an amount sufficient to retain the fibers in assembled relationship when the liquid binder material is soldified, said impregnating step being performed by differential application of liquid binder material to said web across its width and in bands across the web evenly spaced along its length to give different sections of said web different degrees of wettability for water, and thereafter solidifying said liquid binder material to thereby form said non-woven fabric.

5. The method of forming a non-woven fabric comprising:

(a) forming a mixed assemblage of short and long fibers into a web of specified width and of a length greater than the width, (b) impregnating said web with curable liquid binder compositions having different water wettability characteristics after curing by localized application of each of said binder compositions to different sections of the width of said web, each in an amount sufficient to retain the fibers in said web sections impregnated therewith in an assembled relationship when said binder compositions are cured, and (c) curing said binder compositions to retain the fibers in assembled relationship and to thereby form said nonwoven fabric in which said different sections have different degrees of water wettability in said non-woven fabric subsequent to curing.

6. The method of forming a non-woven fabric comprising:

(a) forming a mixed assemblage of short and long fibers into a web of specified width and of a length greater than the width, (b) impregnating said web with curable liquid binder compositions having different water wettability characteristics after curing by:

(i) applying to one portion of the width of said web a first curable binder composition, containing a wetting agent and having a given degree of water wettability after curing, in an amount sufficient to retain the fibers in said one portion in an assembled relationship when said first curable binder composition is cured, and (ii) applying to another portion of the width of said web a second curable binder composition, without a wetting agent and having a lesser degree of water wettability after curing than said first binder composition, in an amount sufficient to retain the fibers in said another portion of an assembled relationship when said second curable binder composition is cured, and (c) curing said binder compositions to retain the fibers in assembled relationship and to thereby form said nonwoven fabric, in which said one portion and said another portion have different degrees of water wettability in said non-woven fabric subsequent to curing.

7. The method of forming a non-woven fabric comprising:

(a) forming a mixed assemblage of short and long fibers into a web of specified width and of a length greater than the width and having a given degree of water wettability, (b) impregnating said web with curable liquid binder composition which, when cured, is less water wettable than said web, by:

(i) applying said binder composition to one portion of the width of said web in a given amount sufficient to retain the fibers of the impregnated one portion of the web in an assembled relationship when said binder composition is cured and, (ii) applying said binder composition to another portion of the width of said web in an amount greater than said given amount, and (c) curing said binder composition to retain the fibers in assembled relationship and to thereby form said nonwoven fabric, in which said one portion and said another portion have different degrees of water wettability for said non-woven fabric subsequent to curing.

8. The method of forming a non-woven fabric comprising:

(a) forming a mixed assemblage of short and long fibers into a web of specified width and of a length greater than the width, (b) impregnating said web with curable liquid binder compositions having different water wettability characteristics after curing by localized application of one of said compositions to strips extending entirely across the web at locations evenly spaced along the length of said web and by localized application of each of said binder compositions to different sections of the width of said web between said strips to provide different degrees of water wettability to said sections in said non-woven fabric after curing, each of said binder compositions being applied to the web in an amount sufficient to retain the fibers of the impregnated web in an assembled relationship when said binder compositions are cured, and (c) curing said binder compositions to retain the fibers in assembled relationship and to thereby form said non-woven fabric.

* * * * *